United States Patent [19]

Keel

[11] 3,930,386

[45] Jan. 6, 1976

[54] PLATING FEEDERS

[75] Inventor: Frederick Keel, Narborough, England

[73] Assignee: The Bentley Engineering Company, Limited, England

[22] Filed: Sept. 18, 1973

[21] Appl. No.: 398,393

[30] Foreign Application Priority Data

Sept. 23, 1972 United Kingdom ..... 44097/72

[52] U.S. Cl. ..... 66/134; 66/136

[51] Int. Cl.[2] ..... D04B 15/60; D04B 9/34

[58] Field of Search ..... 66/134, 136, 137, 139, 66/14

[56] References Cited

UNITED STATES PATENTS

| | | | |
|---|---|---|---|
| 507,929 | 10/1893 | Pringle | 66/136 |
| 1,893,808 | 1/1933 | Spector | 66/136 |
| 2,139,790 | 12/1938 | Zimic et al. | 66/136 |
| 2,192,625 | 3/1940 | Thurston et al. | 66/136 |
| 2,470,803 | 5/1949 | Bristow | 66/136 X |
| 2,796,752 | 6/1957 | Hauberg | 66/136 |
| 2,988,907 | 6/1961 | Bruce | 66/136 |
| 3,157,035 | 11/1964 | Boutillette | 66/136 |

FOREIGN PATENTS OR APPLICATIONS

| | | | |
|---|---|---|---|
| 4,120 | 1889 | United Kingdom | 66/136 |
| 80,335 | 1894 | Germany | 66/136 |
| 143,562 | 1902 | Germany | 66/136 |

*Primary Examiner*—W. C. Reynolds
*Assistant Examiner*—A. M. Falik
*Attorney, Agent, or Firm*—Robert E. Burns; Emmanuel J. Lobato; Bruce L. Adams

[57] ABSTRACT

A plating feeder for use in a circular knitting machine comprises a first mouth for supplying a first yarn, and a second mouth for supplying a second yarn and which is movable relative to the first and second mouths together to alter the angle between the yarns fed by the plating feeder during knitting. The first mouth is provided on an elongate first feeder part and the second mouth is provided on a second feeder part slidable lengthwise on the first feeder part. A biasing spring urges the first and second mouths together and a cam follower coacts with the movable mouth and engages with a cam to override the spring. The first mouth is in a form of a narrow aperture for defining a single yarn feed position for a facing yarn and the second mouth is in a form of a trough at least partly surrounding the first mouth for defining alternative, interconnected yarn feed positions for a backing yarn on either side of the first mouth.

17 Claims, 4 Drawing Figures

PLATING FEEDERS

BACKGROUND OF THE INVENTION

The invention relates to plating feeders for use in circular knitting machines and in particular knitting machines having arrangements for exchanging feeders during knitting.

Plating may be effected by feeding a pair of individual yarns with one yarn having a lead over the other at a plating angle. The plating angle is critical and requires the yarns to be fed along converging paths from the feeder. Separate mouths are provided on plating feeders for each of the yarns which are spaced from one another.

Feeders on knitting machines may be exchanged during knitting. This involves moving the feeder, trapping and cutting the yarn to separate the last part of the knitted yarn from the feeder, when taking a feeder out of action. When inserting a feeder, the exchange involves laying the yarn between the active needles or licking the new yarn into the hooks of the needles by means of latches.

When applying plating feeders to machines having facilities for exchanging feeders, the requirement for separate and spaced feeder mouths conflicts with the need for precise location of the last part of the knitting yarn for trapping and cutting and of the new yarn for initially feeding it to the needles. In double cylinder machines the problem is more acute as feeder movement up or down is restricted by the cylinders and the only free movement used in exchanging feeders is in a direction tangential to the cylinders.

Another problem arises when plating during reciprocation of a circular machine. In that case the plating angle must be reversed when reversing the direction of knitting so as to maintain the yarns in proper relationship. Whatever the application of a plating feeder, it should also be capable of adjusting the plating angle to adapt it to different requirements. The adjustment is often critical and requires great skill.

It is an object of the invention to provide a plating feeder or a method of control of such a feeder which enables it to be exchanged for another feeder.

It is a further object to provide a plating feeder suitable for use in reciprocatory plating and which is easily adjustable.

It is also an object to provide such plating feeders which may be used on double cylinder machines.

SUMMARY OF THE INVENTION

In accordance with this invention there is provided a plating feeder for use in a circular knitting machine comprising a first mouth for supplying a first yarn and a second mouth for supplying a second yarn movable relative to the first mouth so as to alternatively separate or bring the first and second mouths together. In this way the plating feeder can be operated to alter the angle between the yarns fed by the plating feeder during knitting whenever the plating feeder is moved into or out of the operative plating position. Preferably the first mouth is provided on an elongate first feeder part and the second mouth is provided on a second feeder part, slidable lengthwise on the first feeder part. Advantageously a spring is provided to urge the first and second mouths together and a cam follower is associated with the movable mouth for engaging with a cam to override the spring. Suitably the first mouth is in a form of a narrow aperture for defining a single yarn feed position for a facing yarn and the second mouth is in a form of a trough at least partly surrounding the first mouth for defining alternative, interconnected yarn feed positions for a backing yarn to either side of the first mouth. Thus if the direction of knitting were reversed, the backing yarn would float to the other feed position whereas the facing yarn would not shift sideways. The required plating angle can be maintained for forward, reverse and during reciprocatory knitting. Conveniently the alternative yarn feed positions are arranged symmetrically with respect to the first mouth. The arrangement also has a small height and is thus capable of clearing latchguards in both cylinders of a superposed double cylinder machine and feeding the yarns from positions close to the cylinder. Suitably the first mouth is adjustably supported by a mounting so as to enable the space between the mouth and the mounting to be varied.

The movable mouth may be pivotably mounted instead of slidable to bring the mouths together and separate and/or facilitate reciprocatory knitting. The mouth for the backing yarn may also be narrow to define a single feeding position but this would require a greater spacing between the mouths during plating. Preferably the movable mouth is adapted to feed the backing yarn. The movable mouth could however be adapted to project forward of the other mouth to supply the facing yarn.

Using such plating feeders the yarns can be fed to the needles along paths at a predetermined angle during plating. For commencement of plating, the yarns can be fed parallel and close together to facilitate the licking in of the yarns. In the same way the yarns can be brought into a trapping and cutting block as in the case of a single yarn when terminating the operation of a plating feeder.

The plating feeders can be mounted on any circular knitting machine after the knitting machine has been adapted to exercise control over the relative movements of the mouths of the plating feeder. Preferably the plating feeder is mounted on a feeder mechanism adapted to move the plating feeder in and out of action tangentially with respect to the knitting machine. The first mouth may be moved and the movement timed in many ways such as by cables, hydraulic action etc. Using a cam control however a simple and reliable construction can be made. Preferably then a stationary cam arrangement is associated with the knitting machine for controlling the movement of the second mouth. The cam may be operative to control the position of the second mouth along all or part of its path as the plating feeder is moved into or out of action and the cam action may be effected using a cam and the cam follower associated with the movable mouth urged against the cam by a spring. Preferably the cam arrangement is adjustable to vary the extent of separation of the first and second mouth and the cam arrangement comprises a single cam for separating the second mouth from the first only at the plating position of the plating feeder. The plating feeder is preferably mounted so as to have the feeder parts mounting the first and second mouths extending radially with respect to the circular knitting machine. The plating feeder may be one of a plurality of alternative feeders of a yarn changing mechanism adapted to exchange feeders during knitting. Conveniently the mechanism is of a type in which the feeders are taken in and out of action by a sliding movement of a shank on which the respective feeders are mounted in a direction tangential to a cylinder or cylinders of the circular knitting machine as described in the British Patent specifications 301,350 and 301,360. Preferably the cam is arranged so as to move the second feeder part away from the needle cylinder against a spring action and to allow the spring to move the first and second yarns, emerging from the feeders close together when the plating feeder is moved to either side of the cam.

In accordance with this invention there is also provided a method of plating for a limited period while knitting is in progress on a circular knitting machine which method comprises feeding a backing and facing yarn to needles of the circular knitting machine from separate and relatively movable feeder mouths, controlling said feeder mouths to move the backing and facing yarn together at the commencement and/or termination of plating and controlling said feeder parts to supply the backing and facing yarn at a predetermined angles respectively to the needles while plating.

BRIEF DESCRIPTION OF THE DRAWINGS

The invention is particularly described with reference to the drawings in which.

DESCRIPTION OF PREFERRED EMBODIMENT

Figure 1:
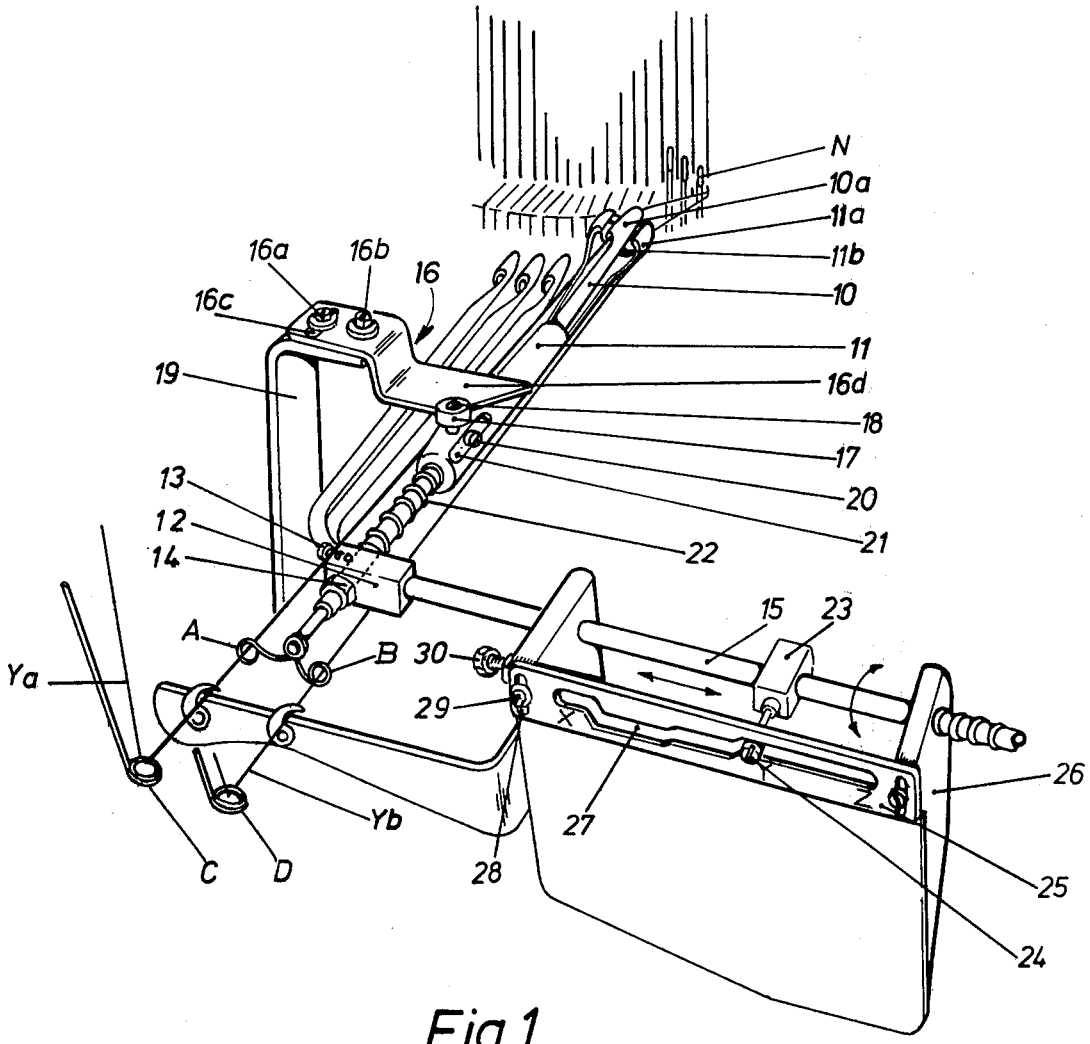
FIG. 1 is a perspective view showing a plating feeder according to the invention in its operative position mounted in a feeder cage.

With reference to the Figures, there is shown part of a superposed double cylinder knitting machine having needles N with latches L in rotatable cylinders and a yarn changing mechanism mounted outside the cylinders which comprises a yarn cutting and trapping block and a number of alternative yarn feeders. The yarn changing mechanism is substantially as described in the British Patent specifications 301,350 and 301,360. All feeders are adapted to move towards or away from the needle cylinders to take them in or out of action by a feeder shank 15 slidably mounted for movement in a tangential direction in a fixed U-bracket 26. The feeder shank 15 comprises a mounting for securing one of the feeders to the bracket 26 of the knitting machine. The feeders are adapted move up or down as required during such sliding movement by the engagement of a pin 24 mounted on a block 23 fixed to the shank 15 with a slot 27 formed in a plate 25 which causes the shank 15 to rotate. For fine adjustment of such up and down movements, the plate 25 is adjustable by means of a vertical slot 28 and a screw 29 for locking the plate to the U-bracket 26. One of the feeders is adapted for plating and will now be described in detail.

On the end of the feeder mounting shank 15 is mounted a connecting block 12 through which is bored a hole holding a rod-like feeder part 10. The feeder part 10 is held in position with respect to the block 12 by a lock-screw 13. Fine adjustment of the position of the feeder part 10 can be effected by an adjusting nut 14 screwed onto the feeder part 10 and engaging the block 12. The feeder part 10 extends generally towards the needle cylinder and is provided at the end 10*a* which is directed to the needles with a mouth in the form of a hole 10*b* for guiding a yarn.

On the rod-like feeder part 10, intermediate the end 10*a* and the connecting block 12, is mounted a trough-shaped feeder part 11. The trough-shaped feeder part 11 is provided with a longitudinal slot 21 through which a pin 20 fixed to the feeder part 10 protrudes. By this arrangement rotation of the feeder part 11 around the feeder part 10 is prevented. The feeder part 11 can thus slide along the feeder part 10 within the limits of the slot 21. The two ends of the slot provide the maximum and minimum separation of the two feeder parts 10 and 11. The trough shaped feeder part 11 is urged towards the needle cylinder by a compression spring 22. At the end facing the needles both sides of the trough shaped feeder part 11 are bent upwardly and inwardly at the end 11 facing the needles forming a substantially U-shaped mouth. A slot 11*b* is further formed in the bottom of the troughlike feeder part 11 adjacent the end 11*a*. The slot 11*b* has a straight edge towards the front of the part 11 and a curved edge towards the rear, which converges to the straight edge in the region where the sides of the trough-shaped feeder part 11 are bent upward and inward. The position of the feeder part 11 is controlled by a camplate 16 which engages a roller 17 mounted on an upright pin 18 on the part 11. The camplate 16 is mounted on a fixed bracket 19 by two screws 16*a* and 16*b*, one of which is mounted in the bracket 19 through a slot 16*c* in the camplate 16. The camplate 16 is arranged to have a generally horizontal portion 16*d* whose edge engages the roller 17. As seen in FIG. 1, the horizontal portion 16*d* is offset downwards with respect to the portion of the camplate 16 secured to the bracket 19 so as to enable movement of the roller 17 beneath the camplate 16 as portrayed in FIG. 2.

The extent of sideways movement of the plating feeder can be adjusted by means of a stop screw 30 mounted in the bracket 26 which is arranged to abut with the rod-like feeder part 10. One plating yarn (Y*a*) can be threaded through take up guide C and a guide A on the rod-like feeder part 10 to pass through the hole 10*b*. Another plating yarn can be threaded through a take-up guide D and guide B to pass through the slot 11*b* into the mouth formed by the space left between the upstanding portions at the end 11*a* of the feeder part 11. In this way the yarn is held steady in the feeder part 11.

The plating feeder movements can be adjusted as required in the following ways:

1. The rod-like feeder part 10 which feeds the face yarn to the needles is adjustable towards or away from the axis of the cylinders by releasing the lock screw 13 and rotating the adjusting nut 14 anti-clockwise or clockwise respectively;

2. The trough-like feeder part 11 which slidably locates over the feeder part 10 and serves to feed a backing yarn to the needles is controlled by the cam plate 16. The correct separation between the two feeder parts 10 and 11 can be obtained by releasing the camplate 16 and rotating it on the screw 16*b* in the rquired direction, then re-locking the screw 16*a* which passes through the slot 16*c* into the fixed bracket 19;

3. Heightwise adjustment of the yarn feeding ends 10*a* and 11*a* of the plating feeder is obtained by adjustment up or down of the feeder control plate 25. The feeder control plate 25 carries the slot 28 which permits the plate to be adjusted up or down when released by the locking screw 29.

In operation with the plating feeder at rest in the non-operating position (FIG. 2) the two yarns Y*a* and Y*b* are held in a cutting and trapping block 31 situated adjacent to the plating feeder.

Figure 3:
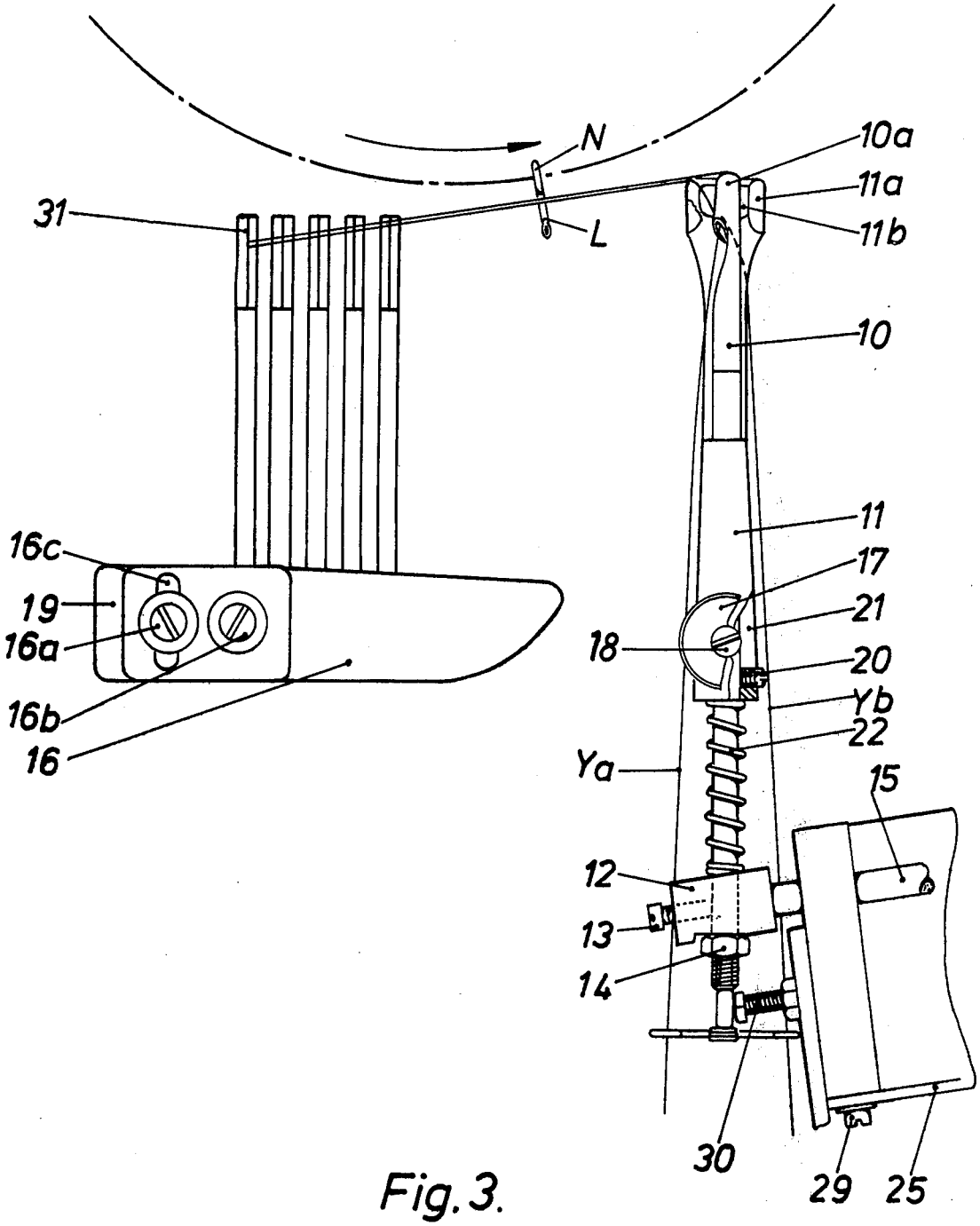
FIG. 3 is a plan view of the plating feeder of FIG. 1 in a position suitable for presenting the yarns to the needles.
Figure 4:
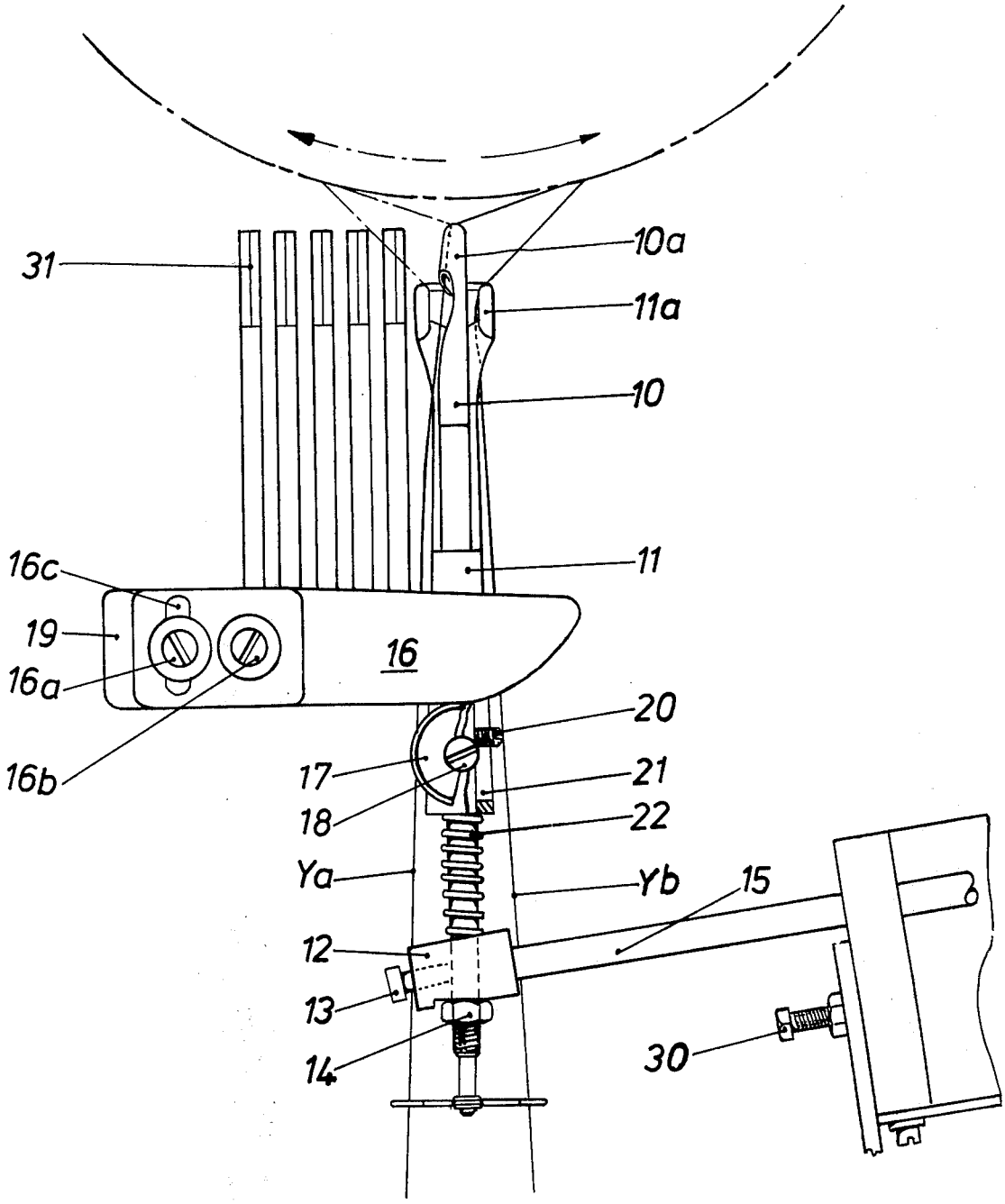
FIG. 4 is a plan view of the plating feeder of FIG. 1 in its operative position as shown in FIG. 1.

When it is required during the knitting cycle of the machine to bring the plating feeder into a yarn feeding position, movement is initiated by the yarn changing mechanism, causing the feeder shank 15 to slide through the bracket 26 until the pin 24, following the cam profile in the control slot 27, comes to rest at a point near Z, through the rod-like feeder part 10 coming into abutment with the adjustable stop screw 30 (FIG. 3). With the plating feeder in this position, the yarns Y*a* and Y*b* still held in the cutting and trapping block 31 are brought closely adjacent to the needles passing down the knitting cam which allows the closing latch L of the needle N to lick the yarns Y*a* and Y*b* into the hook of the needle. The two yarns Y*a* and Y*b* have a minimum of separation at this stage because the roller 17 has lost contact with the cam plate 16, allowing the spring 22 to push the feeder part 11 forward to the limit of the slot 21. As soon as the yarns Y*a* and Y*b* are engaged by the needles N, the trapper block 31 is opened to release the yarn ends, and the feeder is moved to its correct feeding position by the yarn feed mechanism, the pin 24 reaching the point Y on the feeder control plate 25. (FIG. 1). At the same time the roller 17 comes into engagement with the camplate 16 which causes the feeder part 11 to slide along the feeder part 10, compressing the spring 22 and separating the yarns Y*a* and Y*b* into a proper plating relationship (FIG. 4).

The correct yarn feeding position of the plating feeder is set in such a way as to ensure that the two yarns Y*a* and Y*b* are delivered to the needles in a correct plating relationship for both forward knitting and reverse knitting. The plating feeder can be set to lie on a radial line through the axis of the needle cylinder when at its yarn feed position (FIG. 4) (the two yarns Y*a* and Y*b* are shown in full lines for forward knitting and chain dot lines for reverse knitting.) It will be seen that the backing yarn Y*b* is permitted to float from one side of the slot 11*b* to the other according to the direction of knitting during reciprocation of the needle cylinder when producing heels and toes, and this makes sure that the feed angle between the two yarns remains the same in both directions of knitting.

Figure 2:
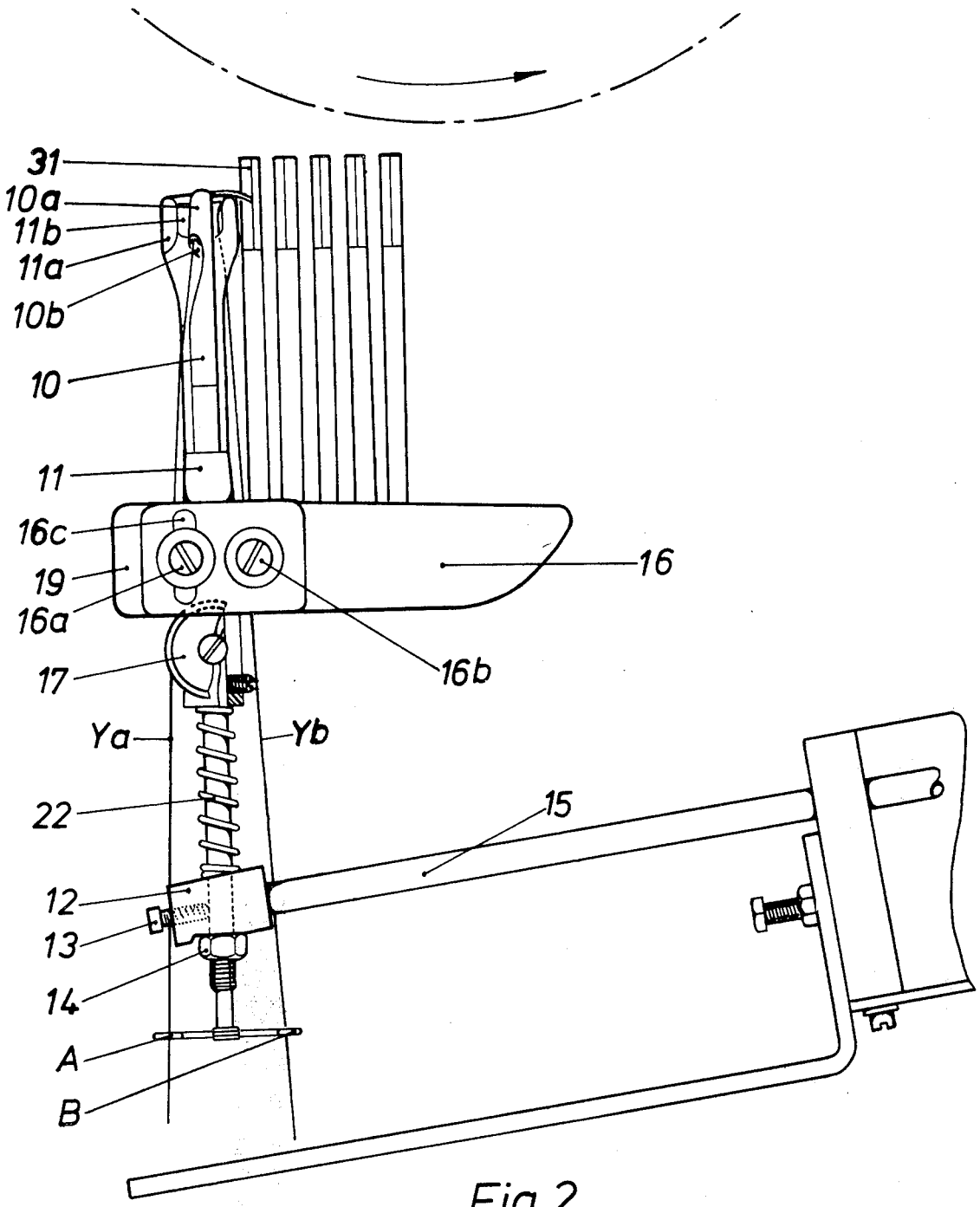
FIG. 2 is a plan view of the plating feeder of FIG. 1 in its rest position with the yarns held in the trapper.

When it is required during the knitting cycle of the machine to withdraw the plating feeder from its active position, movement is again initiated by the yarn feed mechanism to cause the feeder shank 15 to slide through the bracket 26 until the pin 24, following the cam profile in the control slot 27, comes to rest at a point 'X'. During this movement of withdrawal, the two yarns Y*a* and Y*b* and the two feeder parts 10 and 11 remain separated until the roller 17 loses contact with the edge of the horizontal portion 16*d* of the camplate 16. This allows the feeder part 11 to slide along the rod-like feeder part 10 under pressure of the spring 22 until the pin 20 is engaged by the end of the slot 21 (FIG. 2). Thus the two yarns are caused to feed together, one above the other around the flank of the trough-like feeder part when entering the cutting and trapping block 31.

To avoid contact and damage to the needle latches when the plating feeder is introduced or withdrawn, the feeder cage is controlled in the well known manner by the yarn feed mechanism disclosed in the British Patent specifications Nos. 301,350 and 301,360.

In practising the invention it can easily be arranged that the face thread which is to appear at the outer face of the fabric, and the backing thread which is to appear at the inner face of the fabric, are fed to the knitting needles of the machine so that the threads will be engaged by the hooks of the needles in their proper relationship when each stitch is drawn, the face thread lying in the hook of the needle close to the shank and the backing thread lying in the hook of the needle on the outer side of the face thread. The same setting of the plating feeder can be made to give the proper relationship when rotating the needle cylinder in either direction or during reciprocatory knitting when the cylinder reciprocates during the production of heels and toes.

The yarns can be led in a separated condition to the needles during plating. On withdrawal of the feeder the yarns can be easily cut and trapped in a trapper since the two yarns lie close together during withdrawel of the feeder. By providing separate control of the angle between the yarns during plating and during commencement and termination of feed, the setting of the plating angle is less critical as the operator need not be concerned with reducing this angle as much as possible so as to ensure proper trapping and feeding of the new yarn. The plating feeder can thus also be used satisfactorily for a wide range of yarns.

The plating feeder has feeder parts 10 and 11 for the face and backing threads which are individually adjustable and which can be moved relative to one another automatically during knitting to give a proper angle for plating and bring them close together for the initial feeding to the needles and the final cutting and trapping. Thus the plating feeder in a particular adjustment position can cope with a variety of yarns.

What I claim is:

1. Plating feeder comprising: a mounting shank for securing the plating feeder during use to a circular knitting machine; a first feeder part in the form of an elongate body, a first mouth defined at the extremity of the first feeder part for feeding a first yarn, and means rigidly securing the first feeder part to the mounting shank; and a second feeder part having a portion encircling a portion of said first feeder part and slidable lengthwise with respect to said elongate body, a second mouth defined at the extremity of the second feeder part for feeding a second yarn, and means mounting the second feeder part for movement with respect to the mounting shank to enable the first and second mouths to be held separated from one another during plating or brought into close proximity to one another during cutting and trapping or initial feeding of the yarns.

2. Plating feeder as claimed in claim 1 including resilient means for biasing the first and second mouths into close proximity, and a cam follower mounted on the second feeder part for overriding the bias of the resilient means.

3. Plating feeder as claimed in claim 1 wherein the first mouth is defined by a narrow aperture in the first feeder part to provide a single feed position for a facing yarn and the second mouth has upwardly and inwardly inclined portions on either side of the first mouth to provide alternative, interconnected yarn feeder positions on either side of the first mouth.

4. Plating feeder as claimed in claim 1 wherein said means rigidly securing the first feeder part comprises means releasably securing the first feeder part to the mounting in a plurality of positions to vary the distance between the first mouth and the mounting shank.

5. A circular knitting machine comprising at least one needle cylinder; at least one knitting station; a plurality of interchangeable feeders for supplying yarn to said knitting station, at least one of said feeders being a plating feeder comprising a mounting for securing the plating feeder to the knitting machine; a first feeder part in the form of an elongate body, a first mouth defined at the extremity of the first feeder part for feeding a first yarn, and means rigidly securing the first feeder part to the mounting; a second feeder part having a portion encircling a portion of said first feeder part and slidable lengthwise with respect to said elongate body, a second mouth defined at the extremity of the second feeder part for feeding a second yarn, means mounting the second feeder part for movement with respect to the mounting, and means for moving the second feeder part to enable the first and second mouths to be held separated from one another during plating or brought into close proximity to one another during cutting and trapping or initial feeding the yarns.

6. A circular knitting machine as claimed in claim 5 including resilient means for biasing the first and second mouths into close proximity, and a cam follower mounted on the second feeder part for overriding the bias of the resilient means.

7. A circular knitting machine as claimed in claim 5 wherein the first mouth is defined by a narrow aperture in the first feeder part to provide a single feed position for a facing yarn and the second mouth has upwardly and inwardly inclined portions on either side of the first mouth to provide alternative, interconnected yarn feed positions on either side of the first mouth.

8. A circular knitting machine as claimed in claim 5 wherein said means rigidly securing the first feeder part comprises means releasably securing the first feeder part to the mounting in a plurality of positions to vary the distance between the first mouth and the mounting.

9. A circular knitting machine according to claim 5 in which the plating feeder is mounted in a bracket and is slidable bodily in said bracket in a direction tangential with respect to the knitting machine.

10. A circular knitting machine as claimed in claim 9 in which the means for moving the second feeder part comprises a cam acting on the second feeder part to separate the first and second mouths during plating.

11. A circular knitting machine as claimed in claim 9 in which the means for moving the second feeder comprises a cam acting on the second feeder part to separate the first and second mouths during plating and means for adjusting the cam to enable the extent of separation during plating to be varied.

12. A circular knitting machine including at least one needle cylinder; at least one knitting station; a plurality of interchangeable, alternatively operable feeders for supplying yarn to said knitting station; a first feeder part defined by each of the feeders and comprising an elongate body directed toward said cylinder; a second feeder part defined by each of the feeders and comprising a second elongate body which extends substantially tangentially of said cylinder; means mounting the plurality of feeders and engaging the second feeder part of each of the feeders so as to permit bodily sliding movement of the feeders substantially tangentially of said cylinder; a plurality of trappers for trapping yarn from inoperative feeders and wherein at least one of said feeders, being a plating feeder includes said first feeder part on which a first mouth is defined at its extremity for feeding a first yarn; a third feeder part, a second mouth defined at the extremity of said third feeder part for feeding a second yarn, the third feeder part being mounted slidably on the first feeder part so as to permit the third feeder part to slide along the first feeder part; and means in part fixed with respect to the trappers and the feeder mounting means and in part on the third feeder part for camming the third feeder part along the first feeder part on tangential bodily movement of the plating feeder whereby said first and second mouths can be held separated in an operative position during plating or brought into close proximity during cutting and trapping on one side of the operative position and initially feeding the yarns from an inoperative position on the other side of the operative position.

13. A circular knitting machine as claimed in claim 12; wherein the third feeder part has at least a portion which completely surrounds a portion of the first feeder part.

14. A circular knitting machine as claimed in claim 12; wherein the means for camming the third feeder part includes resilient means to bias the first and second mouths into close proximity, a cam follower mounted on the third feeder part, and a cam fixed with respect to the trappers and feeder mounting means for overriding the bias of the resilient means.

15. A circular knitting machine as claimed in claim 12; wherein the first mouth is defined by a narrow aperture in the first feeder part to provide a single feed position for a facing yearn, and the second mouth comprises upwardly and inwardly inclined flanges on either side of the first mouth to provide alternative, interconnected yarn feed positions on either side of the first mouth.

16. A circular knitting machine as claimed in claim 12; in whch the first feeder part is releasably secured to the second feeder part and rigidly securable thereto in a plurality of positions to vary the distance between the first mouth and the cylinder.

17. A circular knitting machine as claimed in claim 12; wherein the means for camming the third feeder part includes resilient means to bias the first and second mouths into close proximity, a cam follower mounted on the third feeder part, and a cam fixed with respect to the trappers and feeder mounting means for overriding the bias of the resilient means and wherein the cam acting on the cam follower on the third feeder part is releasably securable whereby the extent of separation of the first and second mouths in the operative position can be varied.

* * * * *